United States Patent [19]

Spohr

[11] 4,103,727

[45] Aug. 1, 1978

[54] SLATTED BLINDS

[75] Inventor: Horst Spohr, Cuxhaven, Fed. Rep. of Germany

[73] Assignee: Bautex Adolf Stöver KG., Langen-Sievern, Fed. Rep. of Germany

[21] Appl. No.: 740,181

[22] Filed: Nov. 9, 1976

[30] Foreign Application Priority Data

Dec. 3, 1975 [DE] Fed. Rep. of Germany ..... 2554351
Jun. 23, 1976 [DE] Fed. Rep. of Germany ..... 2628162

[51] Int. Cl.[2] ..... E06B 9/30
[52] U.S. Cl. ..... 160/168 R; 160/172; 160/176 R
[58] Field of Search ..... 160/166–178

[56] References Cited

U.S. PATENT DOCUMENTS 3,298,425 1/1967 Cayton et al. ..... 160/176

FOREIGN PATENT DOCUMENTS 1,159,635 7/1969 United Kingdom ..... 160/172

*Primary Examiner*—Peter M. Caun

[57] ABSTRACT

A slatted blind comprises vertically disposed slats each mounted at a top end thereof on pivot means carried for rotation about a vertical axis by a respective guide carriage movable along a support rail. At least one of the guide carriages carries a nut provided externally with a first gear ring, the nut being rotatably and axially immovably mounted on the carriage and being engaged on a rotatable threaded operating rod extending longitudinally of the support rail. The pivot means comprises a bush and a shaft retained in the bush, the slat being mounted on the shaft and a top end of the bush being provided externally with a second gear ring meshing with the first gear ring on the nut. Engaging clutch surfaces of the bush and shaft form a slip clutch operative on rotation of the operating rod to rotate the slat about its longitudinal axis to a limiting position and then to slip to cause displacement of the guide carriage along the support rail.

17 Claims, 12 Drawing Figures

VII
VIII
a
b

SLATTED BLINDS

BACKGROUND OF THE INVENTION

This invention relates to a slatted blind comprising vertically disposed and laterally movable slats which are pivotable about their longitudinal axes.

In particular, the invention concerns a slatted blind of the kind in which each slot is mounted at a top end thereof on pivot means carried by a respective guide carriage movable along a support rail, at least one of the guide carriages carrying a nut which is rotatably and axially immovably mounted on the carriage and is engaged on a rotatable threaded operating rod extending longitudinally of the support rail, a first gear ring rotatable with said nut being meshed with a second gear ring disposed on said pivot means, rotation of said second gear ring in response to rotation of the operating rod being transmitted to said slat through a slip clutch which is operative to rotate the slat about its longitudinal axis to a limiting position and then to slip to cause displacement of the guide carriage along the support rail.

A blind of this kind is disclosed in German Auslegeschrift 1659557. In this known blind, the nut is formed both with internal threading co-operating with the operating shaft and with external threading which constitutes the first gear ring.

In the form of the known blind, each guide carriage is provided with a nut engaged on the operating rod and all the guide carriages are simultaneously displaced along the support rail. In another form only a single traction carriage is is provided with a nut engaged on the operating rod, only this traction carriage being displaced along the support rail by the operating rod, the remaining carriage being entrained by the traction carriage at predetermined spacings. Spacers situated between the pivot means of adjacent slats are provided to limit the relative slidability of the slats.

The known slatted blind suffers from the disadvantage of having a relatively complicated construction. For example, a guide carriage of the known blind comprises 13 or even more individual components. This leads to high manufacturing and assembling costs and more particularly to a corresponding proneness to operating defects. However, manufacturing costs and operational reliability are particularly important features for articles such as slatted blinds which are operated frequently in use. Operation is moreover usually performed by lay people who frequently do not exercise sufficient care. A slatted blind should therefore have adequate operational reliability and a long service life even under such conditions.

Furthermore, the rate of wear of the known blind is unsatisfactory. An important seat of wear is situated in the slip clutch which, in the known blind, is located between the second gear ring and a bottom end of a pivot shaft constituting the pivot means. In this arrangement, the second gear ring is constructed as an externally geared sleeve which extends a taper member provided on the bottom of the pivot shaft. A taper bush is retained in the gear ring sleeve so as to be non-rotatable but axially slidable and is biased into engagement with the taper member by a spring.

It is therefore an object of the invention to improve the known blind so that the manufacturing and assembly costs as well as the storage costs for replacement parts can be substantially reduced and that moreover the operational reliability is improved and the rate of wear is reduced.

SUMMARY OF THE INVENTION

Accordingly, the present invention provides a slatted blind including: a support rail; a guide carriage movable along said support rail; pivot means mounted on said guide carriage for rotation about a vertical axis; a vertically disposed slat mounted at a top and thereof on said pivot means for rotation about its longitudinal axis by said pivot means; a rotatable threaded operating rod extending longitudinally of said support rail; a nut rotatably and axially immovably mounted in said guide carriage and engaged on said operating rod for rotation by said operating rod; a first gear ring rotatable with said nut; a second gear ring disposed on said pivot means and meshing with said first gear ring; and a slip clutch through which rotation of said second gear ring in response to rotation of said operating rod is transmitted to said slat, said slip clutch being operative to rotate said slat to a limiting position and then to slip to cause displacement of said carriage along said support rail, said pivot means including a bush and a shaft retained in said bush, said second gear ring being provided on the outside of said bush at a top end thereof; said slip clutch including engaging clutch surfaces of said bush and said shaft.

Other objects, advantages and features of the invention will become apparent from the following detailed description of preferred embodiments, given with reference to the appended drawings.

DESCRIPTION OF PREFERRED EMBODIMENTS

Figure 1:
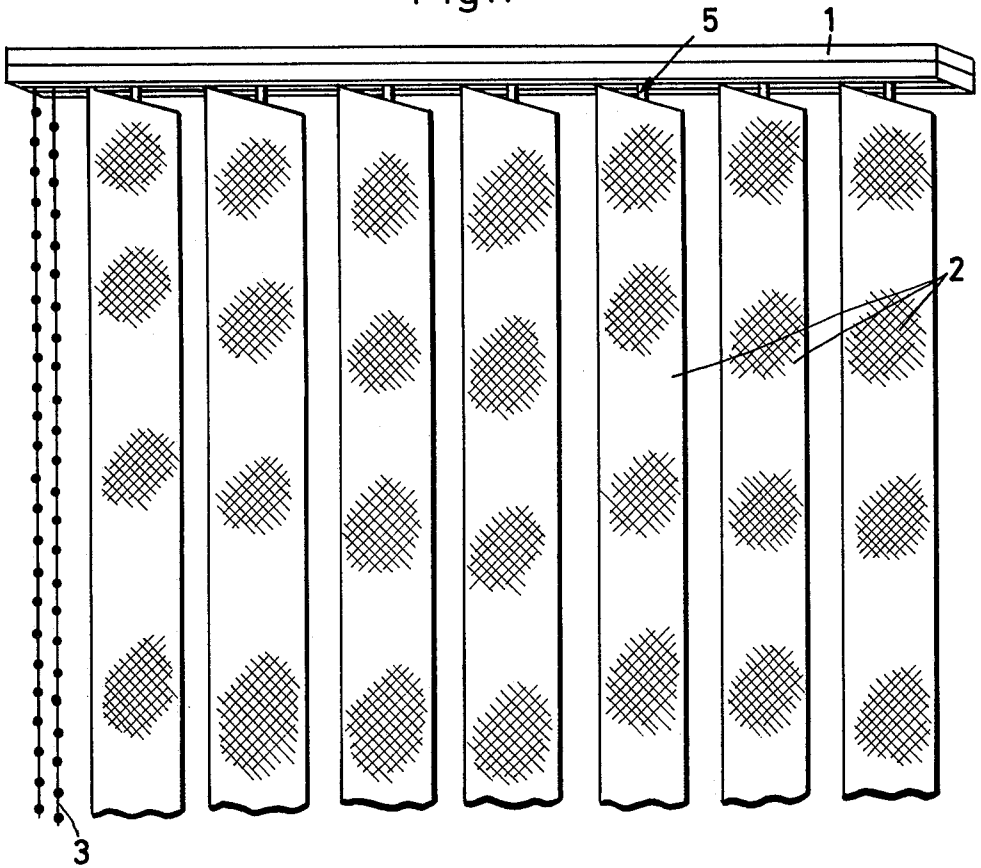
FIG. 1 is a perspective view of a top part of a blind embodying the invention.

FIG. 1 of the drawing shows a slatted blind having a supporting rail 1 from which are suspended vertically disposed slats 2 which are laterally slidable in the supporting rail 1 by means of a pull cord 3 and are pivotable about their vertical longitudinal axes. A rail of the said kind can also be provided at the bottom end of the slats 2 in some embodiments (not shown).

Figure 2:
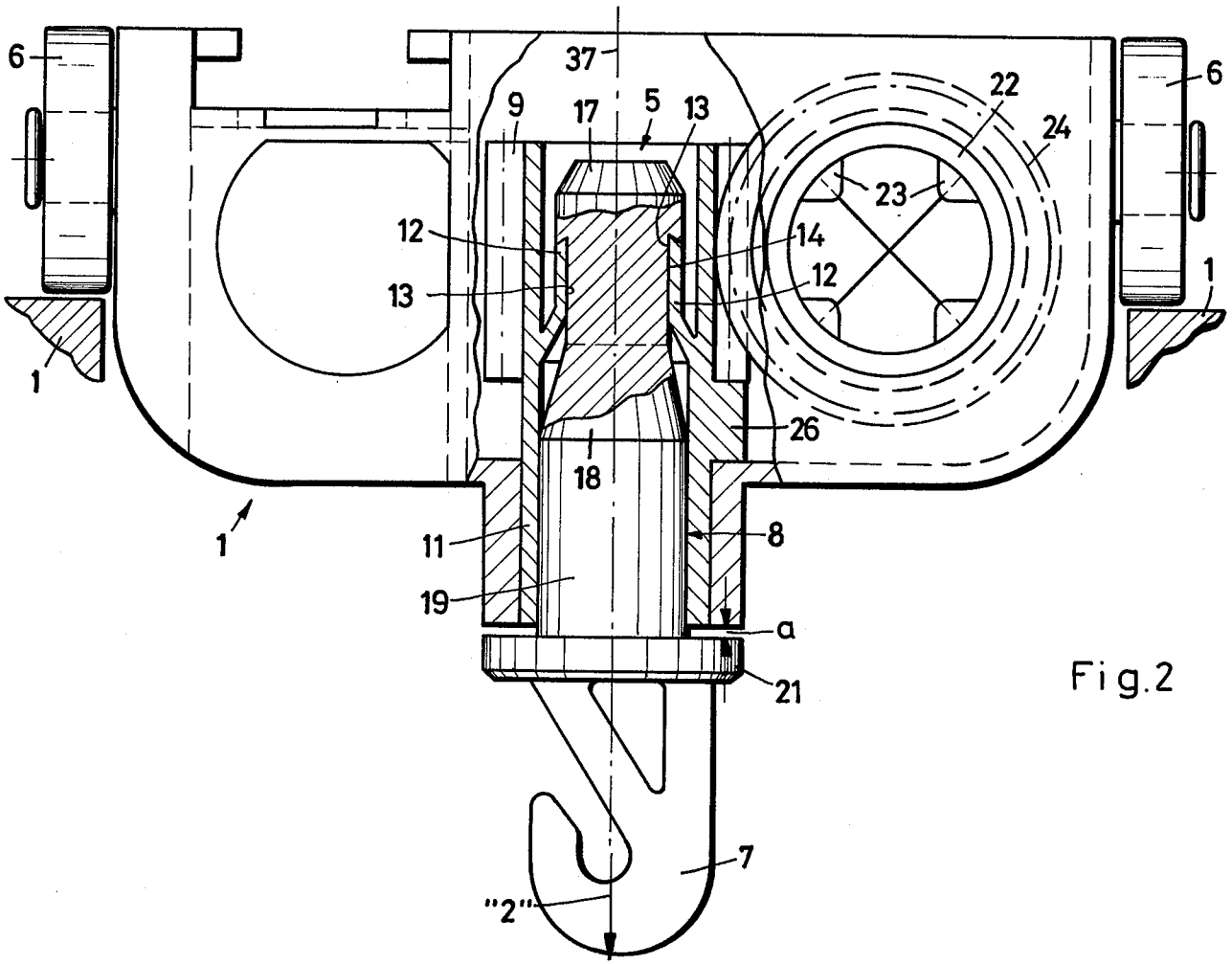
FIG. 2 is a side view on an enlarged scale, of a guide carriage shown partly in section.

The top end of each slat 2 is connected to a guide carriage 4 (see FIG. 2), the connection being obtained by suspending the appropriate slat 2 on pivot means 5 of the respective guide carriage 4, a bottom end of the pivot means 5 being constructed as a hook-shaped holder 7 for the slat indicated by an arrow "2" in FIG. 2. The guide carriages 4 are guided in the supporting rail 1 by means of laterally disposed rollers 6.

Figure 3:
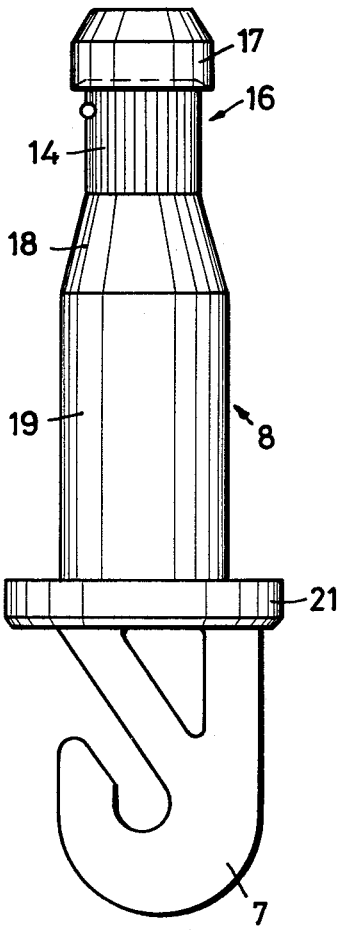
FIG. 3 shows a pivot mounted in the guide carriage of FIG. 2.
Figure 4:
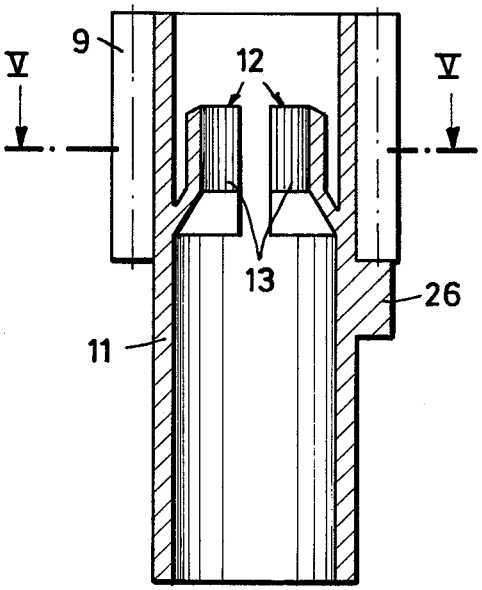
FIG. 4 is an axial section on the line IV—IV of FIG. 5 through a bush which is associated with the shaft of FIG. 3 to form the pivot means of the guide carriage of FIG. 2.
Figure 5:
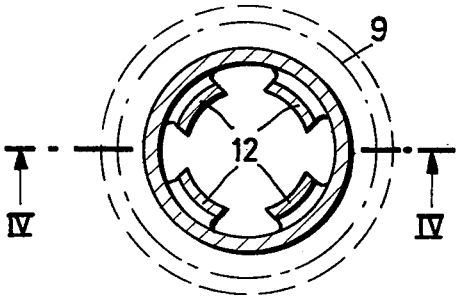
FIG. 5 is a cross-section through the bush of FIG. 4 on the line V—V of FIG. 4.

Each pivot means 5 comprises a shaft 8 and a bush 11 which are constructed of plastics material. These parts will be described in detail below and are separately illustrated in FIGS. 3 to 5.

A rotatably supported operating shaft, not shown in the drawing, is situated in the supporting rail 1 and extends longitudinally over substantially the entire length of the support rail. The operating shaft is provided with screwthreading and extends through the guide carriages 4 in engagement with a screwthreaded nut 22 in each guide carriage 4.

The screwthreaded nuts 22 are rotatable in the respective guide carriages 4 but are supported therein so as to be axially immovable. The nuts 22 have internal screwthreading 23 which meshes with the screwthreading of the sliding shaft and external screwthreading 24 which meshes with a gear ring 9 which is formed on the outside of the top end of the bush 11 and is integral therewith.

Each bush 11 has four internal projections 12 provided with knurling 13.

Each projection 12 is constructed in the manner of a resilient finger having an end free for limited resilient movement relative to the internal surface of the bush 11, the projection as being fixedly joined to the internal surface of the bush 11 at its other end and being integral with the said bush.

The knurling 13 of the projection 12 co-operate with knurling 14 which is provided on part of the shaft 8. The shaft 8 is formed at one end with the slat holder 7 and at its other end with a flange-like enlarged portion 17. The bottom of the portion 17 is undercut to co-operate with the top edge of the projections 12 in a positive manner and bears upon the bush 11 (see FIG. 2).

An end portion of the shaft 8 projects from a tubular portion 15 of a housing 10 of the guide carriage and is formed with a flange 21 which carries the slat holder 7, a slight clearance *a* being provided between the flange 21 and a free end of the housing portion 15. A stop abutment 26 formed on the bush 11 provides vertical support for the pivot means 5 in the housing 10.

The pivoting motion of the slats 2 can be limited in known manner by adjacent slats bearing upon each other. The pivoting motion of the slats can however also be controlled by stop abutments (not shown), each of these being formed, for example, as a radial projection of the flange 21 to ensure locking of the slat holders 7 on reaching a limiting position.

The method of operation of the blind illustrated in FIGS. 2 to 5 is as follows:

In the starting position, all the slats 2 are situated at one end of the guide rail 1 where they are bunched together to form a stack. If a pull is applied to the pull cord 3, the operating shaft, not illustrated in the drawing, will rotate the stationary slats 2 about their longitudinal axis 37 through rotation of the screwthreaded nuts 22 until the limit of the pivoting motion is reached. The rotation of the operating shaft is then translated by the screwthreaded nuts 22 into a sliding motion of the guide carriages in the course of which the slip clutches 13, 14 slip. The blind is closed at the end of this procedure.

If the operating shaft is subsequently rotated in the opposite direction, the slats 2 will again be pivoted and then slide back into the starting position.

In the embodiment illustrated in FIGS. 6 to 12, the shaft 8 is frictionally engaged with the internal surface of the bush 11. To this end, the shaft 8 is provided with two pairs of oppositely disposed and radially extending stubs 27 whose radially outward end faces 28 (FIG. 7) correspond to the internal surface 29 of the bush 11 and bear with a press fit on the adjacent portion 30 of the internal surface 29 of the bush 11. Adjacent stubs 27 are offset by 90° from each other (see FIG. 7) and they are situated adjacent to a bottom end of the shaft 8 which is provided with the slat holder 7.

A support flange 31 for the shaft 8 is provided on the top end of the shaft 8. The support flange 31 is constructed integrally with the shaft 8 and must be slid from below through the bush 11 in the direction of the arrow 32. The top end of the bush 11 is provided with four fingers 33 on which the support flange bears and which secure the support flange 31 against slipping out or being pulled downwardly - i.e. in the direction opposite to that indicated by the arrow 32.

A cylindrically constructed abutment portion 34 in frictional engagement with the internal surface 29 of the bush 11 is provided adjacent the top end of the shaft 8. This also prevents tilting or jamming of the shaft portion 8 in the bush 11.

Figures 6, 7, 8:
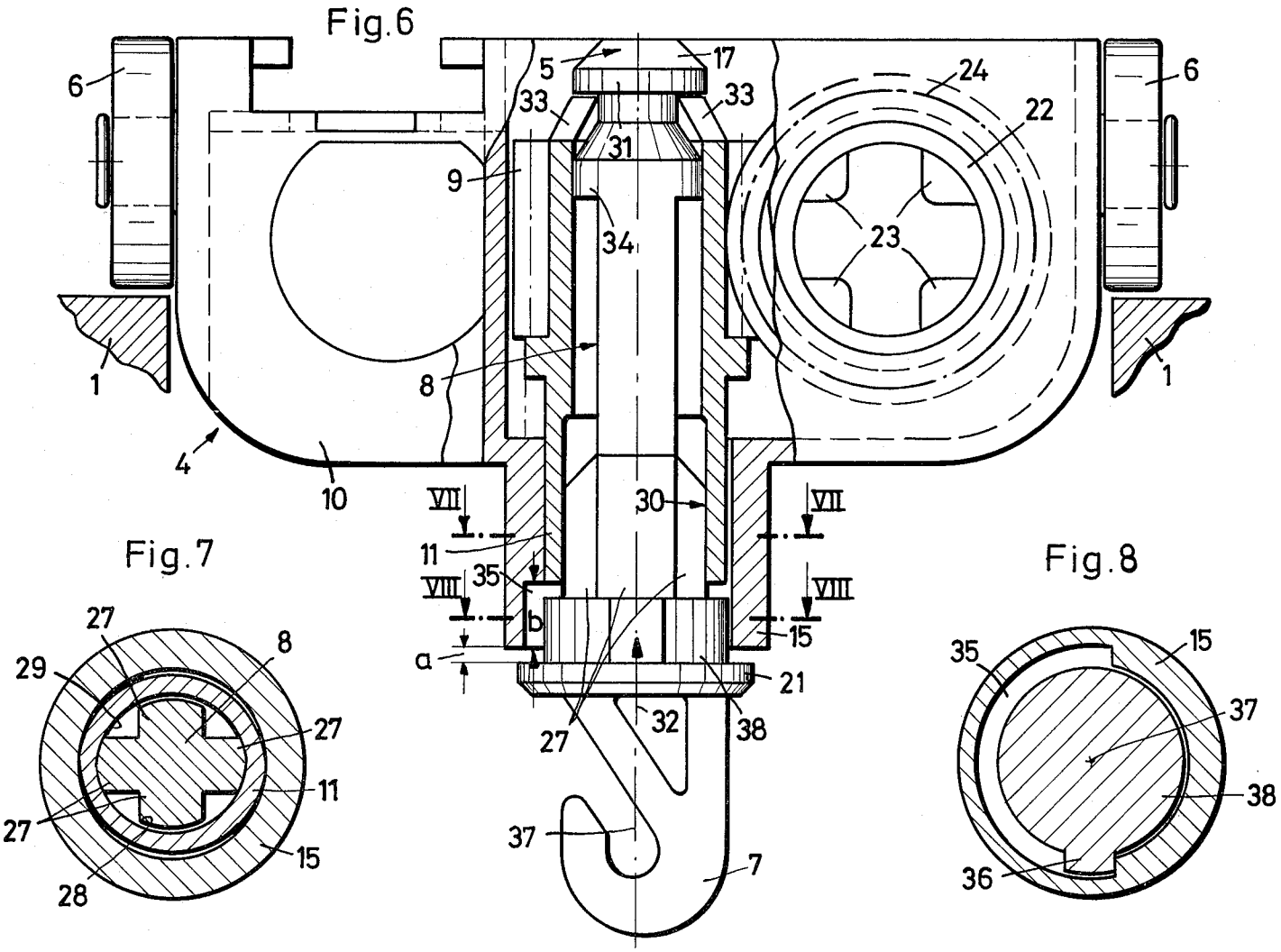
FIG. 6 is a side view of another form of guide carriage for a blind embodying the invention, shown partly in section.
FIG. 7 is a sectional view through the guide carriage of FIG. 6 on the line VII—VII.
FIG. 8 is a sectional view of the guide carriage of FIG. 6 on the line VIII—VIII of FIG. 6.
Figure 9:
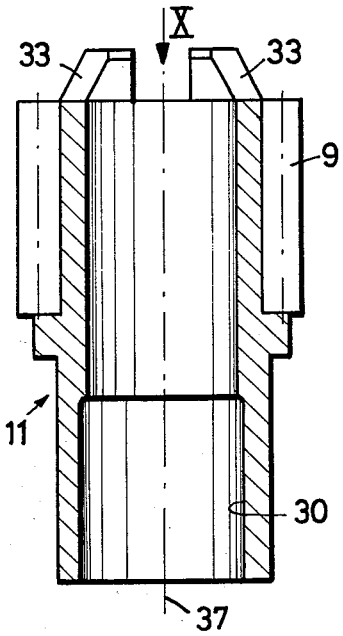
FIG. 9 is a longitudinal section through a bush mounted in the guide carriage of FIG. 6.
Figure 11:
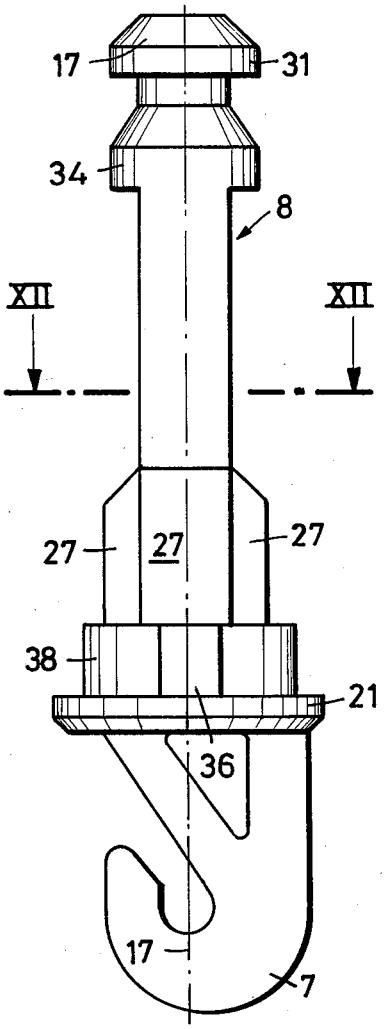
FIG. 11 shows in side view a shaft associated with the bush in the guide carriage of FIG. 6.
Figure 10:
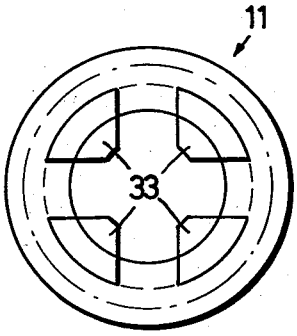
FIG. 10 is an end plan view from above of the bush in the direction indicated by the arrow X of FIG. 9.
Figure 12:
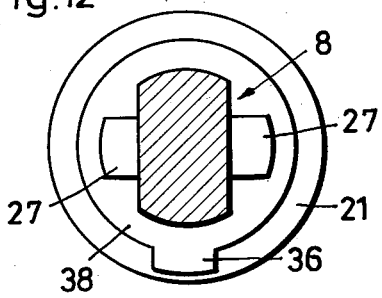
FIG. 12 is a section through the shaft of FIG. 11 on the line XII—XII.

The portion 15 of the housing 10 of the guide carriage 4 which encloses a bottom end portion of the bush has a slightly larger diameter than the bottom end portion of the bush 11, as can be seen by reference to FIG. 7. This results in deformation of the bottom end portion of the bush 11 from a circular into an elliptical cross-section, as indicated in FIG. 7, so that the desired frictional engagement is obtained between the external surface of the bush 11 and the internal surface of the housing portion 15 and between one pair of stubs 27 of the shaft 8 and the internal surface 29 of the bush 11.

The bottom end portion of the bush 11 terminates inside the housing portions 15 at a distance *b* from the bottom end of the housing portion 15. At its bottom end the housing portion 15 has an internal recess 35 in which is received a stop abutment 36 on the shaft 8. The recess 35 is approximately semicylindrical and is concentric with the axis 37 of the slat. As can be seen more particularly by reference to FIG. 8, the stop abutment 36 is formed on an enlarged part 38 of the shaft portion 8 and is in the form of a radial projection.

The method of operation of the blind illustrated in FIGS. 6 to 12 is as follows:

All slats 2 of this embodiment are also situated at one end of the guide rail 1 in the starting position. When a pull is applied to the pull cord 3, the operating shaft, not illustrated in the drawing, pivots the stationery slats 2 about their longitudinal axes 37 through rotation of the screwthreaded nuts 22 until the pivoting motion is limited by the stop abutments 36. The pivoting motion of the operating shaft is then translated by the screwthreaded nuts 22 into a sliding motion of the guide carriages in the course of which the slip clutches 27/30 and 28/30 and 34/29 slip. The blind is closed at the end of this procedure.

If the operating shaft is subsequently rotated in the opposite direction, this will be initially accompanied by pivoting of the slats 2 followed by sliding of the guide carriages until the starting position is regained.

A special advantage of a blind embodying the invention is that a guide carriage 4 together with all individual components will then comprise only six parts, while 14 and more parts were necessary in known blinds. This has an advantageous effect not only on manufacturing costs, installation costs and storage costs, but also favourably affects the operational reliability and finally, the rate of wear, which is particularly advantageous because of the large surface area engagement of the slip clutch.

Blinds embodying the invention are particularly suitable for freely suspended systems. They can however also be employed in the case of slats which are guided at both ends, and in this case guide carriages which apply spring stress to the blades should be disposed in the second support rail which must be provided in such a case.

I claim:

1. A slatted blind consisting of a support rail, vertically disposed slats which are all rotateable to a limited extent around their longitudinal axes and which are shiftable laterally on said support rail, a guide carriage for each slat, pivot means positioned in said guide carriage, a screw threaded shaft extending through said guide carriages, threaded nuts mounted in said guide carriages and fitted on said shaft, said nuts having inner threads matching the screw threads on the shaft, a bush arranged on the pivot means of each slat, a gear ring formed on the outside of said bush, said nuts also having outer threads for driving said gear rings, said pivot means having friction surfaces and said bush having pressure surfaces resiliently acting on said friction surfaces to form a slip clutch, said bush being provided with a plurality of integral resilient fingers spacedly mounted from the body of said bush so that when said pivot means are inserted to be in operative position the fingers flex inwardly and when operative frictional mating occurs the fingers are released from said inward deflection and operatively bear upon said friction surfaces with said friction surfaces and said resilient fingers being in mating and locked relationship with respect to each other, said fingers having said pressure surfaces which are knurled and said friction surfaces on said pivot means also being knurled with said slip clutch components being operatively engaged only by exertion of frictional forces.

2. A slatted blind according to claim 1, wherein said gear ring is formed integrally with said bush.

3. A slatted blind according to claim 1, wherein said pivot means comprises a shaft having an enlarged portion with means for positively engaging the free ends of said fingers.

4. A slatted blind according to claim 1, wherein said guide carriage comprises a housing having a tubular portion, said pivot means comprises a shaft having an end portion projecting from said tubular portion for attachment of a slat, and said end portion of said shaft having a flange carrying a holder for said slat.

5. A slatted blind according to claim 1 wherein said bush and said pivot means are made of plastics material.

6. A slated blind having a support rail, vertically disposed slats which are all rotateable to a limited extent around their longitudinal axes and which are shiftable laterally on said support rail, a guide carriage for each slat, pivot means positioned in said carriage, screw threaded shafts extending through said guide carriages threaded nuts mounted in the guide carriages and fitted on said shaft, said nuts having inner threads matching the screw threads on the shaft, a bush arranged on the pivot means of each slat, a gear ring formed on the outside of the bush, said nuts also having outer threads for driving the gear rings, said pivot means and bush having frictionally engaged surface constituting a slip clutch, said pivot means being provided with a pair of oppositely disposed and radially extending stubs having radially outward end faces bearing with a press fit on the internal surface of said bush, said bush including a plurality of integral resilient fingers spacedly mounted from the body of said bush so that when said pivot means are inserted to be in operative position the fingers flex inwardly and when operative frictional mating occurs the fingers are released from said inward deflection and operatively bear upon said friction surfaces with said friction surfaces and said resilient fingers being in mating and locked relationship with respect to each other.

7. A slatted blind according to claim 6, wherein said pivot means comprises a shaft, and there are two pairs of said stubs thereon.

8. A slatted blind according to claim 7, wherein adjacent ones of said stubs are angularly spaced apart by 90°.

9. A slatted blind according to claim 7, wherein one pair of said stubs has a radial extent which is less than the radial extent of the other pair of said stubs.

10. A slatted blind according to claim 7, wherein one end of said pivot means comprises a holder for said slat, said stubs being provided adjacent said one end of said pivot means.

11. A slatted blind according to claim 10, wherein said pivot means comprises an enlarged abutment portion adjacent to the other end of said pivot means said abutment portion being frictionally engaged with the internal surface of said bush.

12. A slatted blind according to claim 6, wherein one end of said pivot means comprises a holder for said slat, the other end of said pivot means being provided with a support flange bearing on said bush.

13. A slatted blind according to claim 12, wherein said support flange is integral with said pivot means and said bush comprises inwardly extending resilient support fingers on which said support flange bears.

14. A slatted blind according to claim 6, wherein said guide carriage has a housing including a tubular housing portion enclosing a portion of said bush at the location of said frictionally engaged surface, said tubular housing portion having an internal diameter which is larger than the external diameter of said enclosed portion of said bush.

15. A slatted blind according to claim 6, wherein said pivot means carries a stop abutment for defining limiting rotational positions of said pivot means, said guide carriage having a housing provided with a recess in which said stop abutment of said pivot means is received.

16. A slatted blind according to claim 15, wherein said housing recess is substantially semicylindrical and is substantially concentric with the longitudinal axis of said slat.

17. A slatted blind according to claim 15, wherein one end of said pivot means comprises a holder for said slat and said stop abutment is provided adjacent said one end of said pivot means.

* * * * *